US012722034B1

(12) United States Patent
Qian

(10) Patent No.: US 12,722,034 B1
(45) Date of Patent: Sep. 1, 2026

(54) DUMBBELL CAPABLE OF MULTI-LEVEL WEIGHT ADJUSTMENT

(71) Applicant: Zhejiang Zhenxiao Beiqi Industry & Trade Co., Ltd., Jinhua (CN)

(72) Inventor: Xiaoying Qian, Huangshan (CN)

( * ) Notice: Subject to any disclaimer, the term of this patent is extended or adjusted under 35 U.S.C. 154(b) by 0 days.

(21) Appl. No.: 19/386,067

(22) Filed: Nov. 11, 2025

(51) Int. Cl.
*A63B 21/075* (2006.01)
*A63B 21/072* (2006.01)
*A63B 71/00* (2006.01)

(52) U.S. Cl.
CPC ..... *A63B 21/075* (2013.01); *A63B 21/0726* (2013.01); *A63B 21/0728* (2013.01); *A63B 71/0036* (2013.01)

(58) Field of Classification Search
CPC ..... A63B 21/0726; A63B 21/0728; A63B 21/075; A63B 21/072; A63B 21/0722; A63B 21/0724; A63B 71/0036
See application file for complete search history.

(56) References Cited

U.S. PATENT DOCUMENTS 11,471,722 B2 * 10/2022 Lu ..... A63B 21/075
12,233,305 B2 * 2/2025 Wang ..... A63B 21/0728
12,427,360 B2 * 9/2025 Li ..... A63B 21/0728

FOREIGN PATENT DOCUMENTS

CN 223248701 U * 8/2025

* cited by examiner

*Primary Examiner* — Megan Anderson

(57) ABSTRACT

The present invention discloses a multi-level adjustable dumbbell. It comprises a dumbbell bar assembly, multiple weight plates, and a base for storing them. The bar assembly includes a rotational adjustment mechanism and supports at both ends, each having an end support, a weight plate holder, and an adjustment frame. The adjustment mechanism, containing a handle tube, a guide shaft, and two slide pins A and B, enables weight adjustment. This is achieved by combining a specific weight plate B with multiple weight plates A via their respective insertion position. Featuring a universal outer profile with only aperture differences, the design allows for high-precision, reliable adjustment through a precision synchronized rack and pinion or magnetic encoding detection. Compared to existing art, this invention doubles the number of adjustable levels and enhances both precision and user convenience.

10 Claims, 9 Drawing Sheets

DUMBBELL CAPABLE OF MULTI-LEVEL WEIGHT ADJUSTMENT

TECHNICAL FIELD

The present invention relates to the technical field of sports equipment, and particularly to a dumbbell capable of multi-level weight adjustment.

BACKGROUND OF THE ART

Dumbbells in the prior art primarily fall into two categories: one is the fixed-weight dumbbell, and the other is the adjustable-weight dumbbell. When using the former, a full set of dumbbells with different weight specifications is required to meet a trainer's needs. The latter, due to its adjustable weight, is highly favored by fitness trainees.

Chinese Patent Publication No. CN104162249A, published on Nov. 26, 2014, discloses a weight-adjustable dumbbell. It mainly consists of a dumbbell bar assembly, a number of weight plates, and a base for placing the weight plates and the dumbbell bar assembly. The dumbbell bar assembly primarily includes a handle tube, two weight plate positioning members mounted at both ends of the handle tube, and a weight adjustment device installed on the weight plate positioning members. The dumbbell bar assembly further includes a steel shaft installed within the handle channel, with weight adjustment devices provided on both end weight plate positioning members.

When using such a dumbbell, the weight plates are placed on the base, and the dumbbell bar assembly is also placed on the base. By rotating the handle tube, the slide pin is gradually rotated outwards, allowing the weight plates of the selected weight to be engaged and locked onto the weight plate positioning members, thereby completing the weight adjustment.

However, in existing dumbbells, the locking holes of the weight plates are typically of the same size, and engagement is achieved solely through the movement of a single slide pin. Consequently, the number of adjustment levels is limited, and the number of adjustable levels is relatively small.

INVENTION CONTENT

To address the above technical problems, the present invention designs a dumbbell capable of multi-level weight adjustment.

In accordance with the present invention, a dumbbell is provided as follows:

A dumbbell capable of multi-level weight adjustment, comprising a dumbbell bar assembly, a plurality of weight plates, and a base for placing the weight plates and the dumbbell bar assembly; the dumbbell bar assembly includes a rotational adjustment mechanism and dumbbell supports disposed at both ends of the rotational adjustment mechanism; each dumbbell support comprises an end support, a weight plate holder, and an adjustment frame; the rotational adjustment mechanism comprises a handle tube, a guide shaft, a slide pin A, and a slide pin B;

The weight plate holder is provided with a plurality of weight plate A insertion positions and a weight plate B insertion position disposed inward of the weight plate A insertion positions, an outer end of the weight plate holder is provided with the end support, an inner end of the weight plate holder is provided with the adjustment frame, a central limiting slot is formed in the weight plate holder, and the guide shaft passes through the handle tube, the central limiting slots of the weight plate holders at both ends, and the adjustment frame, and is fixedly connected to the end supports at both ends;

Slide pins A are respectively sleeved over outer sides of the guide shaft on both ends and located between the handle tube and the guide shaft, each slide pin A is provided with a circumferentially arranged intermittent push track, and the inner side of the handle tube is correspondingly provided with protrusions, wherein rotating the handle tube drives the protrusions to rotate, enabling the protrusions to engage with the intermittent push tracks to drive the slide pins A to move horizontally and intermittently along the guide shaft; simultaneously, slide pins B are sleeved over both ends of the handle tube, each slide pin B is provided with a circumferentially arranged reciprocating push track, and both ends of the handle tube are correspondingly provided with bumps, wherein rotating the handle tube drives the bumps to rotate, enabling the bumps to engage with the reciprocating push tracks to drive the slide pins B to move reciprocally along the guide shaft; the trajectories of the reciprocating push tracks and the intermittent push tracks are configured such that when the slide pins A move horizontally outward, the slide pins B move inward, and when the slide pins A move intermittently, the slide pins B move outward;

The base is correspondingly provided with weight plate A positioning grooves, end support positioning grooves, weight plate B positioning grooves, and adjustment frame positioning grooves; the weight plate A positioning grooves accommodate weight plates A, and the weight plate B positioning grooves accommodate weight plates B; the weight plates A are correspondingly provided with insertion slots A and locking holes A, while the weight plates B are correspondingly provided with insertion slots B and locking holes B; the entry width L2 of the insertion slot B is greater than the diameter D1 of the locking hole A; the diameter of the locking hole A corresponds to the outer diameter of the slide pin A, and the diameter of the locking hole B corresponds to the outer diameter of the slide pin B;

The present invention adopts a universal outer profile design, differing only in aperture, and achieves precise synchronization of weight adjustment through a precision synchronized rack and pinion or magnetic encoding detection.

In the figure: 1. Dumbbell bar assembly, 2. Weight plate A, 3. Base, 4. Weight plate B, 5. Weight plate A positioning groove, 6. Unlocking block, 7. End support positioning groove, 8. Weight plate B positioning groove, 9. Adjustment frame positioning groove, 10. Insertion slot A, 11. Locking hole A, 12. Locking hole B, 13. Insertion slot B, 14. End support, 15. Weight plate holder, 16. Adjustment frame, 17. Handle tube, 18. Weight adjustment dial, 19. Weight plate A insertion position, 20. Weight plate B insertion position, 21. Guide shaft, 22. Slide pin A, 23. Slide pin B, 24. Anti-slip portion, 25. Self-locking block, 26. Self-locking spring, 27. Intermittent push track, 28. Guide block, 29. Reciprocating push track, 30. Limit guide strip.

DETAILED DESCRIPTION

Figure 1:
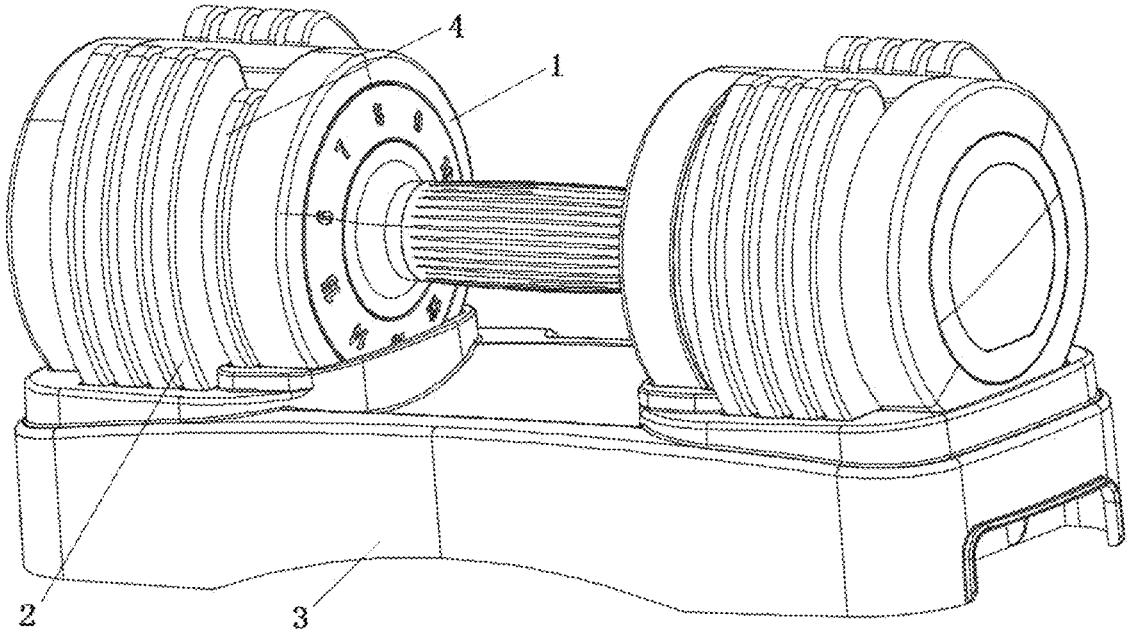
FIG. 1 is a schematic structural view of one embodiment of the present invention.
Figure 2:
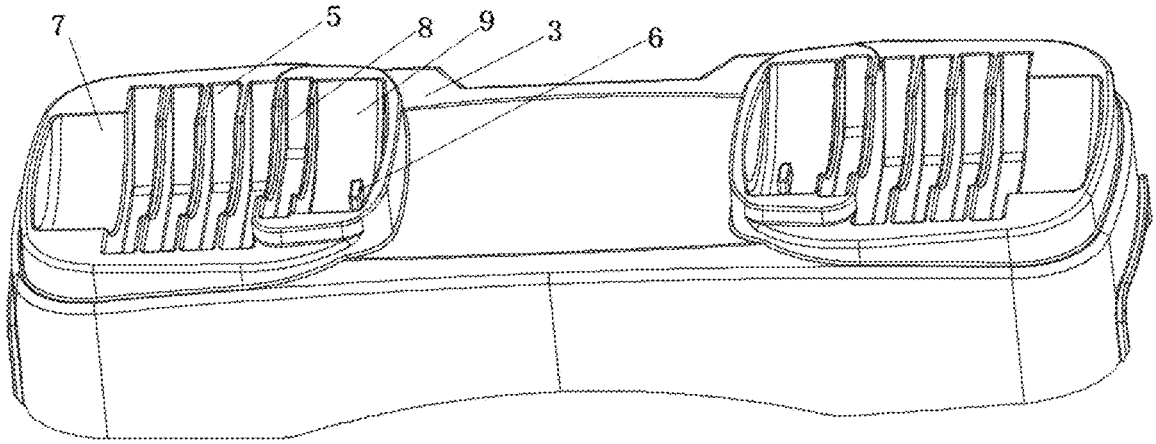
FIG. 2 is a schematic structural view of a base of the present invention.
Figure 3:
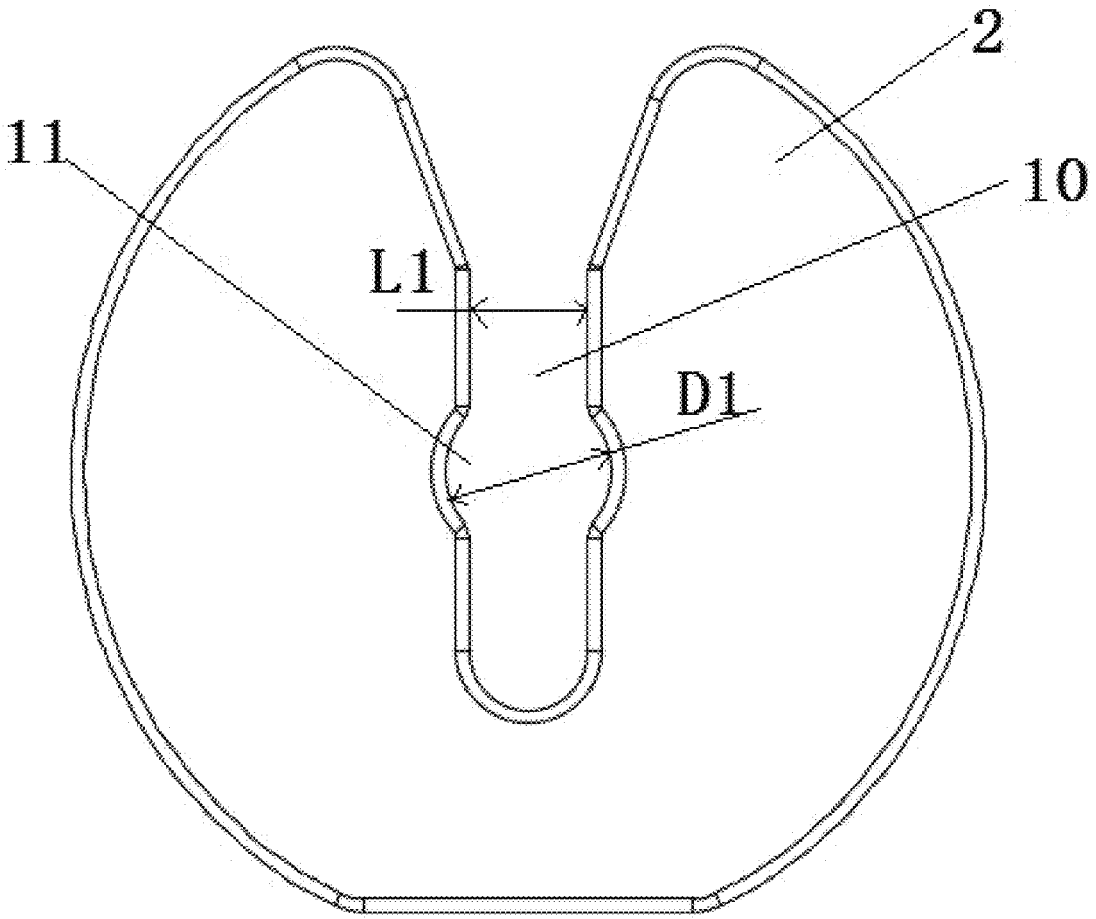
FIG. 3 is a schematic structural view of a weight plate A of the present invention.
Figure 4:
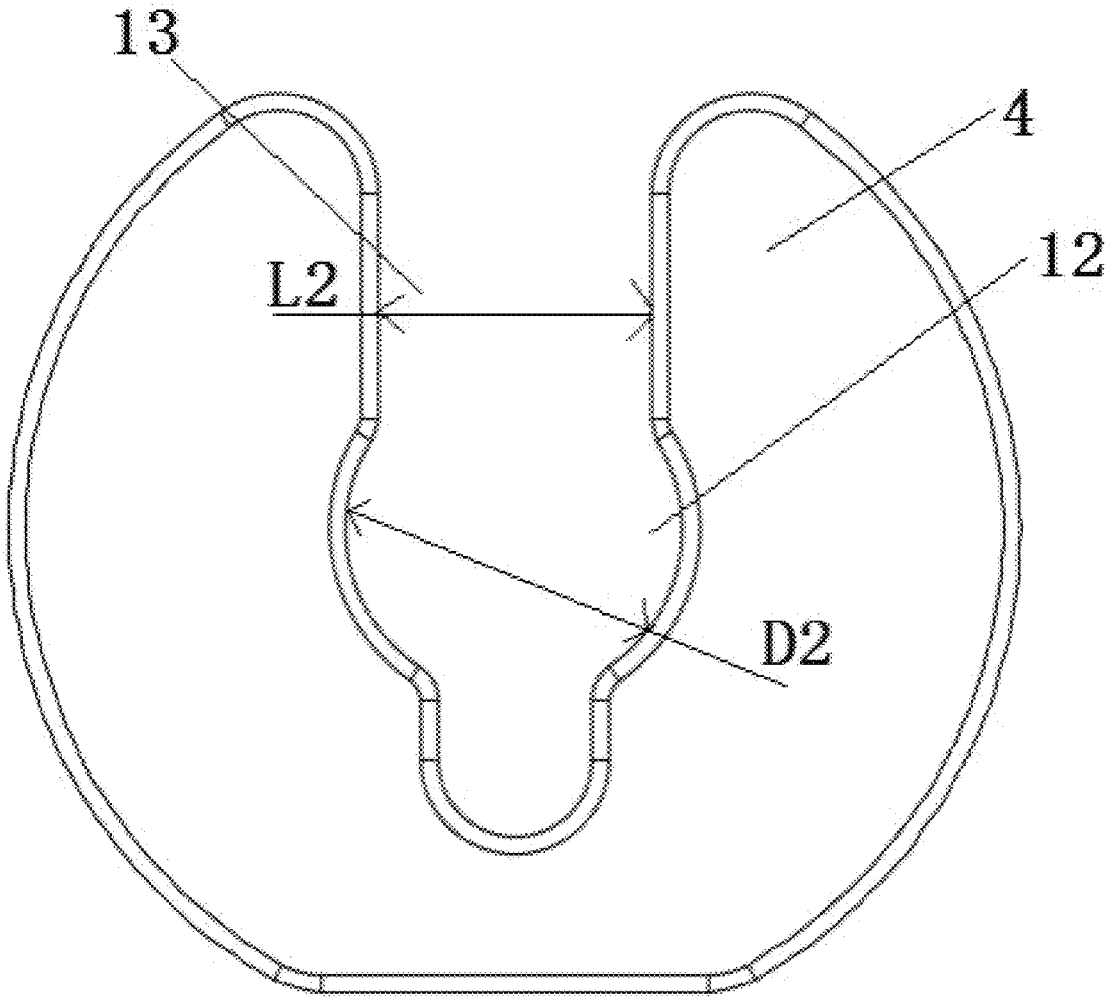
FIG. 4 is a schematic structural view of a weight plate B of the present invention.
Figure 5:
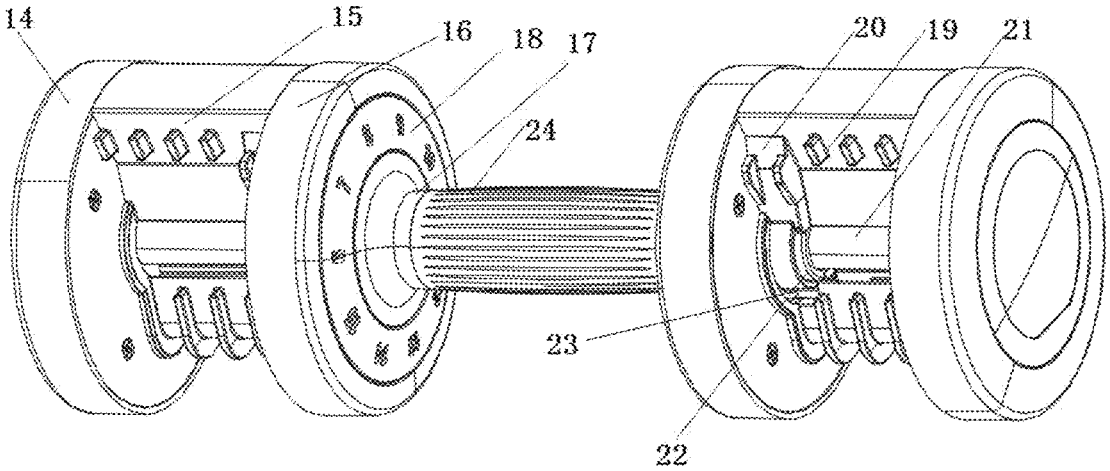
FIG. 5 is a perspective view of a dumbbell bar assembly of the present invention.
Figure 6:
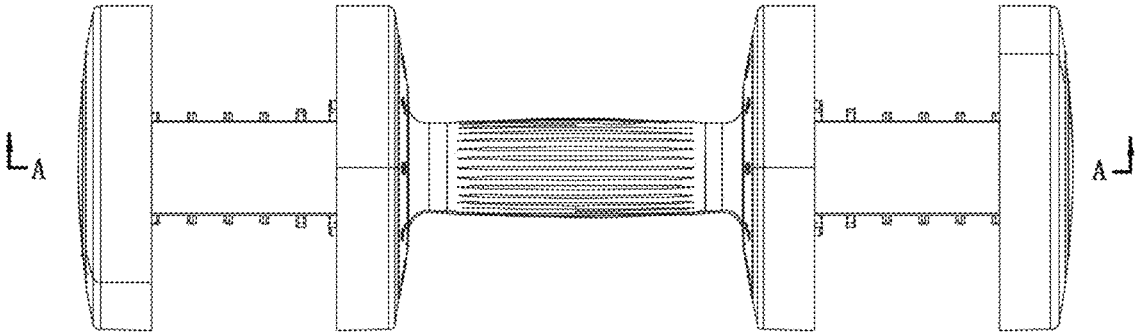
FIG. 6 is a top view of a dumbbell bar assembly of the present invention.
Figure 7:
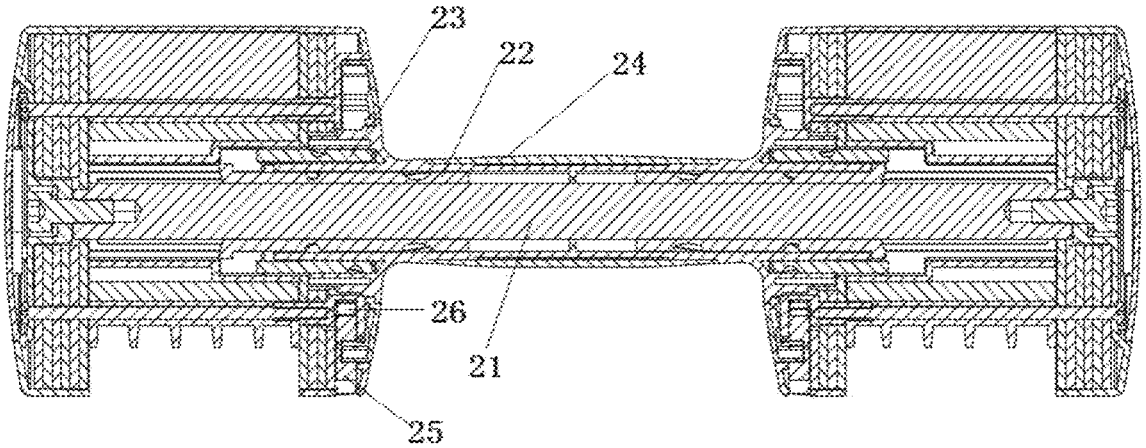
FIG. 7 is a cross-sectional view taken along line A-A in FIG. 6.
Figure 8:
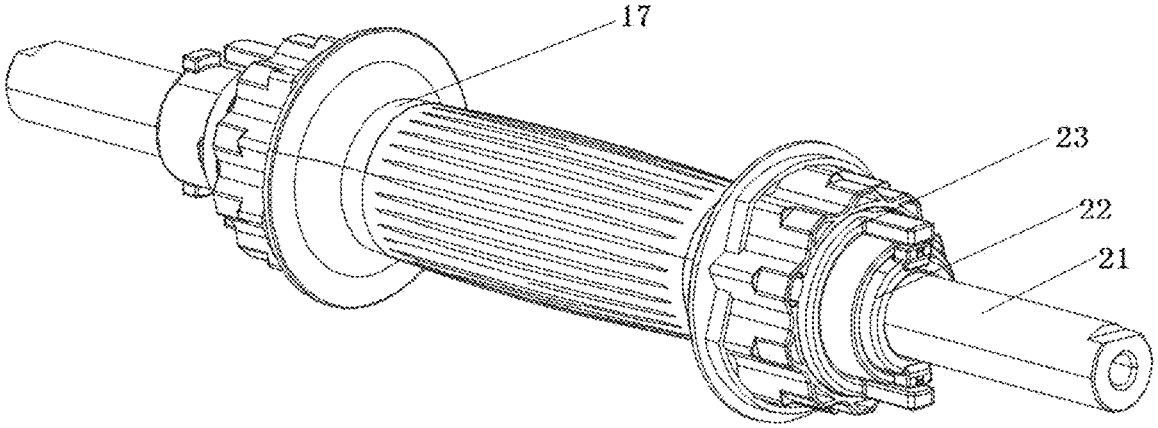
FIG. 8 is a perspective view of a rotational adjustment mechanism of the present invention.
Figure 9:
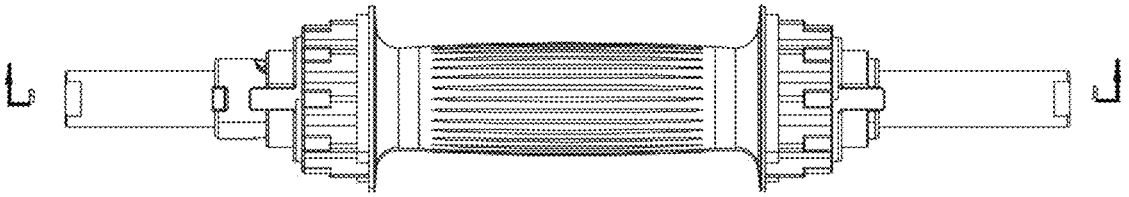
FIG. 9 is a top view of a rotational adjustment mechanism of the present invention.
Figure 10:
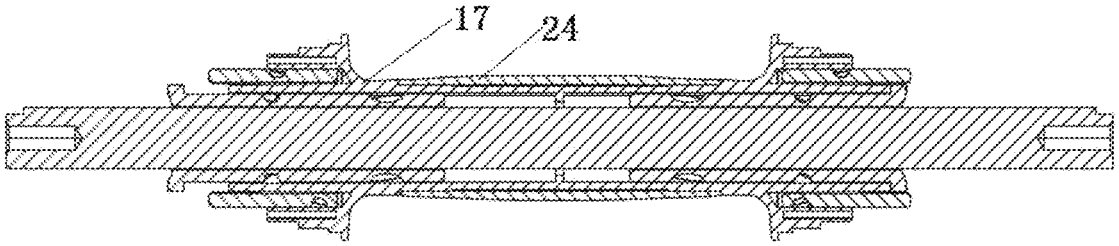
FIG. 10 is a cross-sectional view taken along line B-B in FIG. 9.
Figure 11:
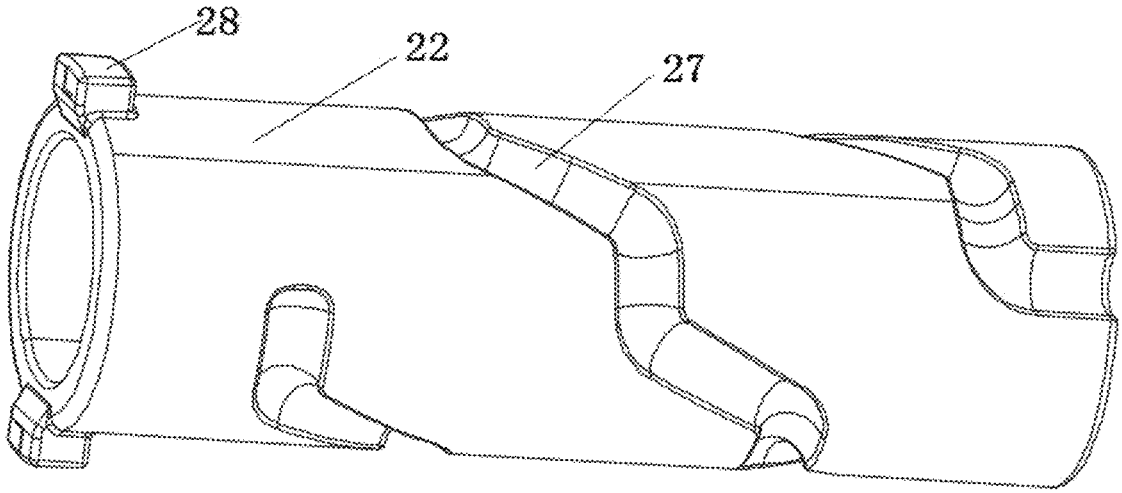
FIG. 11 is a schematic structural view of a slide pin A of the present invention.
Figure 12:
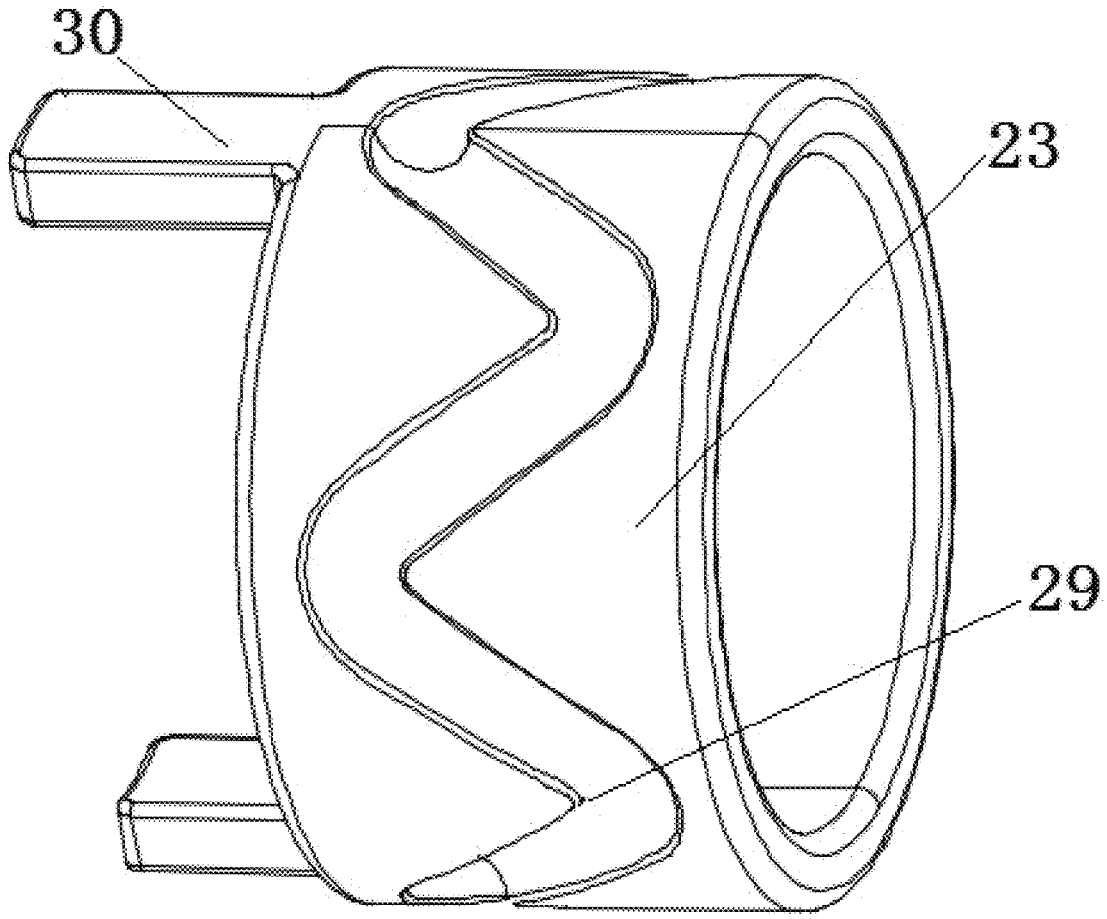
FIG. 12 is a schematic structural view of a slide pin B of the present invention.

The technical solution of the present invention will be further described below through specific embodiments and with reference to the accompanying drawings:

Embodiment: As shown in FIGS. 1-12, a dumbbell capable of multi-level weight adjustment comprises a dumbbell bar assembly 1, a plurality of weight plates, and a base 3 for placing the weight plates and the dumbbell bar assembly.

The dumbbell bar assembly includes a rotational adjustment mechanism and dumbbell supports disposed at both ends of the rotational adjustment mechanism. Each dumbbell support comprises an end support 14, a weight plate holder 15, and an adjustment frame 16. The rotational adjustment mechanism includes a handle tube 17, a guide shaft 21, a slide pin A 22, and a slide pin B 23;

The weight plate holder is provided with a plurality of weight plate A insertion positions 19 and a weight plate B insertion position 20 disposed inward of the weight plate A insertion positions. The outer end of the weight plate holder is provided with the end support, while the inner end is provided with the adjustment frame. A central limiting slot is formed in the weight plate holder. The guide shaft passes through the handle tube, the central limiting slots of the weight plate holders at both ends, and the adjustment frame, and is fixedly connected to the end supports at both ends;

Slide pins A are respectively sleeved on both outer sides of the guide shaft and located between the handle tube and the guide shaft. Each slide pin A is provided with a circumferentially arranged intermittent push track 27. The inner side of the handle tube is correspondingly provided with protrusions. Rotating the handle tube drives the protrusions to rotate, allowing them to engage with the intermittent push tracks and thereby drive the slide pins A to move horizontally and intermittently along the guide shaft. Simultaneously, slide pins B are sleeved on both ends of the handle tube. Each slide pin B is provided with a circumferentially arranged reciprocating push track 29. Both ends of the handle tube are correspondingly provided with bumps. Rotating the handle tube drives the bumps to rotate, allowing them to engage with the reciprocating push tracks and thereby drive the slide pins B to move reciprocally along the guide shaft. The trajectories of the reciprocating push tracks and the intermittent push tracks are configured such that when the slide pins A move horizontally outward, the slide pins B move inward, and when the slide pins A move intermittently, the slide pins B move outward.

The base is correspondingly provided with weight plate A positioning grooves 5, end support positioning grooves 7, weight plate B positioning grooves 8, and adjustment frame positioning grooves 9. The weight plate A positioning grooves accommodate weight plates A 2, while the weight plate B positioning grooves accommodate weight plates B 4. The weight plates A are correspondingly provided with insertion slots A 10 and locking holes A 11, and the weight plates B are correspondingly provided with insertion slots B 13 and locking holes B 12. The entry width L2 of the insertion slot B is greater than the diameter D1 of the locking hole A. The diameter of the locking hole A is matched with the outer diameter of the slide pin A, and the diameter of the locking hole B is matched with the outer diameter of the slide pin B.

Self-locking notches are respectively provided between both ends of the handle tube and the adjustment frames. A self-locking spring 26 and a self-locking block 25 are installed in each self-locking notch. When the self-locking block is not pressed, it locks the adjustment frame and the handle tube, thereby preventing the handle tube from being rotated for adjustment.

An unlocking block 6 is provided in the adjustment frame positioning groove on the base, corresponding to the self-locking block. When the dumbbell bar assembly is placed on the base, the unlocking block presses against the self-locking block, thereby unlocking the adjustment frame and the handle tube.

An unlocking block is provided in the adjustment frame positioning groove on the base, corresponding to the self-locking block. A weight adjustment dial 18 is fixedly connected to each end of the handle tube. An anti-slip portion 24 is disposed on the exterior of the handle tube.

The end support is composed of an outer sleeve and metal sheets, wherein the outer sleeve is filled with the metal sheets and is fixedly connected to both ends of the guide shaft via bolts.

The adjustment frame comprises a housing and metal sheets, wherein the housing is filled with the metal sheets. The metal sheets are fixed on both sides of the weight plate holder via bolts. The slide pin A is provided with a guide block 28, which moves horizontally along corresponding limiting slots provided on the weight plate holders at both ends. The slide pin B is provided with a limit guide strip 30, which moves horizontally along corresponding limiting slots provided on the weight plate holders at both ends.

When using the present invention, the dumbbell bar assembly and multiple weight plates are placed on the base. At this time, the unlocking block presses against the self-locking block, unlocking the adjustment frame and the handle tube. The handle tube can be rotated to achieve ten levels of weight adjustment for the dumbbell. The ten levels are as follows: Level 1: The dumbbell bar assembly with zero weight plates on one side, displayed as 6 kg (lightest); Level 2: One weight plate B on each end plus the dumbbell bar assembly, displayed as 7 kg; Level 3: One weight plate A on each end plus the dumbbell bar assembly, displayed as 8 kg; Level 4: One weight plate A and one weight plate B on each end plus the dumbbell bar assembly, displayed as 9 kg; Level 5: Two weight plates A on each end plus the dumbbell bar assembly, displayed as 10 kg; Level 6: Two weight plates A and one weight plate B on each end plus the dumbbell bar assembly, displayed as 11 kg; Level 7: Three weight plates A on each end plus the dumbbell bar assembly, displayed as 12 kg; Level 8: Three weight plates A and one weight plate B on each end plus the dumbbell bar assembly, displayed as 13 kg; Level 4: Four weight plates A on each end plus the dumbbell bar assembly, displayed as 14 kg; Level 10: Four weight plates A and one weight plate B on each end plus the dumbbell bar assembly, displayed as 15 kg.

The embodiments described above represent only one preferred implementation of the present invention and are not to be construed in any way as limiting the scope of the invention. Other variants and modifications may be made without departing from the technical solution recorded in the claims.

The invention claimed is:

1. A dumbbell capable of multi-level weight adjustment, comprising a dumbbell bar assembly, a plurality of weight plates, and a base for placing the weight plates and the dumbbell bar assembly, the dumbbell bar assembly including a single rotational adjustment mechanism and a pair of dumbbell supports disposed at respective ends of the rotational adjustment mechanism, each of the dumbbell supports comprising an end support, a weight plate holder, and an adjustment frame, characterized in that: the rotational adjustment mechanism comprises a handle tube, a pair of guide shafts, a pair of slide pins A, and a pair of slide pins B; each weight plate holder is provided with a plurality of weight plate A insertion positions with a weight plate B insertion position disposed inward thereof; each guide shaft passes through the handle tube, a central limiting slot of each weight plate holder, and each adjustment frame and is fixedly connected to the respective end support; each slide pin A is configured to move horizontally along an intermittent push track and each slide pin B is configured to move along a reciprocating push track, whereby the intermittent push track and the reciprocating push track enable multi-level weight combination adjustment; and the plurality of weight plates comprise at least one weight plate A and at least one weight plate B having a substantially identical outer profile differing in aperture size, the weight plate A and the weight plate B being configured to achieve synchronized weight adjustment via a synchronization mechanism.

2. The dumbbell capable of multi-level weight adjustment according to claim 1, wherein self-locking notches are provided between both ends of the handle tube and the adjustment frame, a self-locking spring and a self-locking block are installed within the self-locking notches, and the self-locking block locks the adjustment frame and the handle tube in an unpressed state.

3. The dumbbell capable of multi-level weight adjustment according to claim 2, wherein the base is provided with an unlocking block corresponding to the adjustment frame positioning groove, configured to press down the self-locking block to unlock the adjustment frame and the handle tube when the dumbbell bar assembly is placed.

4. The dumbbell capable of multi-level weight adjustment according to claim 1, wherein a weight adjustment dial is fixedly provided at each end of the handle tube and an anti-slip portion is disposed on the outer surface of the handle tube.

5. The dumbbell capable of multi-level weight adjustment according to claim 1, wherein the end support comprises an outer sleeve and metal sheets filled therein and is fixedly connected to the guide shaft via bolts, and wherein the adjustment frame comprises a housing and metal sheets fixed on both sides of the weight plate holder via bolts.

6. The dumbbell capable of multi-level weight adjustment according to claim 1, wherein the slide pin A is provided with a guide block that moves horizontally along the limiting slot of the weight plate holder, and the slide pin B is provided with a limit guide strip that moves horizontally along the limiting slot of the weight plate holder.

7. The dumbbell capable of multi-level weight adjustment according to claim 1, wherein the base, the weight plate holder, and the adjustment frame adopt a modular structure design to facilitate assembly and maintenance.

8. The dumbbell capable of multi-level weight adjustment according to claim 1, wherein a guide slot is provided between the adjustment frame and the weight plate holder for achieving precise alignment of the slide pins.

9. The dumbbell capable of multi-level weight adjustment according to claim 1, wherein the cooperating portions between the slide pins and the handle tube are made of wear-resistant material to ensure long-term reliability.

10. The dumbbell capable of multi-level weight adjustment according to claim 1, wherein a motion state of the entire adjustment mechanism is detectable in real-time through a precision synchronized rack and pinion or magnetic encoding device to ensure accuracy of each weight level.

* * * * *